US006559580B1

(12) United States Patent
Deutsch et al.

(10) Patent No.: US 6,559,580 B1
(45) Date of Patent: May 6, 2003

(54) COMPACT MULTISTAGE SPARK GAP SWITCH

(75) Inventors: Alon Deutsch, Kiryat Motzkin (IL); Avner Rosenberg, Beit-Shearim (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 09/320,572

(22) Filed: May 27, 1999

(30) Foreign Application Priority Data

May 29, 1998 (IL) ..... 124696

(51) Int. Cl.[7] ..... H01J 17/26
(52) U.S. Cl. ..... 313/231.01; 313/325; 361/120
(58) Field of Search ..... 313/231.31, 231.41, 313/231.01, 325, 620, 619; 315/209 PZ, 209 M, 209 CD; 361/120

(56) References Cited

U.S. PATENT DOCUMENTS 473,045 A * 4/1892 Wood ..... 217/40
2,659,842 A * 11/1953 Teszner ..... 313/313
3,328,631 A * 6/1967 Greber ..... 174/150
3,626,237 A * 12/1971 Bolton et al. ..... 313/307
4,027,187 A * 5/1977 Rabe ..... 313/217
4,052,639 A * 10/1977 Cunningham ..... 313/231.11
4,077,020 A * 2/1978 Anderson et al. ..... 331/94.5
4,148,089 A * 4/1979 Kerns et al. ..... 361/119
4,356,527 A * 10/1982 Asinovsky et al. ..... 361/134
4,755,719 A * 7/1988 Limpaecher ..... 200/48 R
6,037,715 A * 3/2000 Hammon et al. ..... 313/231.11

OTHER PUBLICATIONS

A. Anvari and O. Steinvall, 1973, Journal of Physics E, vol. 6, pp 1113–1115 (no month).*
Marconi Applied Technologies Limited, Jul. 2000, Issue 2, pp 1–5.*
Martin A. Uman, 1984, Mc–Graw Hill, Dover edition, pp. 47–65.*

* cited by examiner

*Primary Examiner*—Ashok Patel
*Assistant Examiner*—Glenn Zimmerman
(74) *Attorney, Agent, or Firm*—Mark M. Friedman

(57) ABSTRACT

A spark gap switch, including a first planar electrode including a discharge portion and a support portion. The spark gap also includes a second planar electrode parallel to and spaced apart from the first electrode and includes a discharge portion and a support portion. The discharge portions are mutually opposite, and the support portions are mutually staggered.

39 Claims, 11 Drawing Sheets

COMPACT MULTISTAGE SPARK GAP SWITCH

FIELD AND BACKGROUND OF THE INVENTION

The present invention relates to high voltage switches and, more particularly, to a multistage spark gap switch that is more compact than those presently known.

A spark gap switch is a high voltage closing switch that is used in pulsed power systems and for protection from transients. A basic spark gap switch consists of two electrodes separated by an insulating medium that can be vacuum or a fluid (gas or liquid). The switch is initially open. It closes upon the formation of a conductive plasma channel (spark) in the insulating medium between the electrodes when a sufficiently high voltage difference is imposed on the electrodes. The conductive channel is formed by a breakdown mechanism that can be driven in one of two ways. The first way (self-breakdown) involves the application of a voltage difference across the electrodes that is higher than the voltage breakdown threshold of the switch, i.e., the voltage at which the electric field in the gap between the electrodes exceeds the electric strength of the fluid, or induces sufficient electron emission from the surfaces of the electrodes into a vacuum. The second way is to induce breakdown at a voltage difference across the electrodes that is below the voltage breakdown threshold. This is done by using a third, trigger electrode to briefly raise the electric field in the gap between the electrodes, or by means such as radiation or a change in insulator pressure that induce degradation of the electric strength of the insulating medium. The simple and robust structure of spark gap switches, and their ability to self-close and to float to high voltages, makes them popular components of devices such as Marx generators.

The repetition rate of the operation of a spark gap switch is limited by the time required for the plasma to recombine and for the heat associated with the discharge to be dissipated so that the insulator returns to its initial electric strength. Therefore, high repetition rate spark gap switches commonly use a fluid (gas or liquid) insulator that flows through the interelectrode discharge gap. Nevertheless, the repetition rate of these spark gap switches usually is only a few tens of hertz. In addition, the high flow rates required by some applications tend to degrade switching reproducibility and introduce complications in overall system design.

FIG. 1A shows a multistage spark gap switch, which is essentially a series of two-electrode spark gap switches connected back to back. Electrodes 10 are held apart by insulating spacers 12 to define discharge gaps 14. The total switch voltage is divided capacitively among discharge gaps 14, allowing discharge gaps 14 to be very small. This gives the multistage structure fast recovery times, enabling operation at repetition rates upwards of several kilohertz. If the insulating medium is a gas, the pressure of the gas can be atmospheric, simplifying the mechanical and operational complexity of the switch. Fluid flow rate can be very low, or fluid flow may not be required at all. The small discharge gap and low pressure allow the switch to operate in a less violent discharge mode, which considerably increases the lifetime of the electrodes and hence of the switch as a whole.

Historically, the multistage spark gap switch, then called a "quenched spark gap", was first used in the 1920s in sparking transmitters because of its fast recovery time and its high repetition rate. Newer transmitter technologies rendered the multistage spark gap switch obsolete in this application, and it has found little application since then. Until recently, high energy, high voltage pulsed power applications required only a low repetition rate, for which a single stage spark gap switch is adequate. The higher repetition rates of the newest high voltage pulsed power generators requires a different switch technology. In principle, the multistage spark gap switch of FIG. 1A is appropriate for these high repetition rates. In practice, however, the length of a typical multistage spark gap switch gives it an undesirably long closing time and an undesirably large inductance in the conducting phase. The extra length of a multistage spark gap switch, compared with an equivalent single stage spark gap switch, also complicates the layout of a generator with many such switches and may increase the size of the generator, thereby degrading its performance in some applications because of the increased weight, larger inductance and longer rise time associated with the larger size.

Thus there is a widely recognized need for, and it would be highly advantageous to have, a multistage spark gap switch design that is shorter than those presently known.

SUMMARY OF THE INVENTION

According to the present invention there is provided a spark gap switch, including: (a) a first substantially planar electrode including a discharge portion and a support portion; and (b) a second substantially planar electrode parallel to and spaced apart from the first electrode and including a discharge portion and a support portion, the discharge portions being mutually opposite, and the support portions being mutually staggered.

According to the present invention there is provided a spark gap switch including: (a) a first stack of at least two substantially planar, mutually parallel electrodes, each of the electrodes including: (i) a discharge portion, and (ii) a support portion; the discharge portions of adjacent electrodes being spaced apart and mutually opposite, the support portions of adjacent electrodes being mutually staggered.

According to the present invention there is provided a spark gap switch including: a first stack of at least two substantially planar, mutually parallel electrodes, each of the electrodes including a discharge portion, the discharge portions of adjacent electrodes being mutually opposite and spaced apart by at most about one millimeter.

In the prior art spark gap switch of FIG. 1A, spacers 12 must have a certain minimum length to ensure that the spark is confined to discharge gaps 14 and does not propagate from one electrode 10 to the next along the outer surface of an intervening spacer 12. In practice, this length is several (typically three) times the width of any one discharge gap 14. Electrodes 10 are nonplanar, so that when electrodes 10 are stacked as shown, peripheral gaps 16 that are wider than discharge gaps 14 accommodate spacers 12. The main contribution to the length of these prior art spark gap switches is the width of peripheral gaps 16.

FIG. 1B shows an alternative prior art design of a multistage spark gap switch in which planar electrodes 10' are separated by insulating spacers 12'. In this design, discharge volumes 14' are not well-defined and may overlap onto spacers 12'. Therefore, plasma that is produced in discharge volumes 14' attacks spacers 12'. This leads to frequent surface breakdowns on spacers 12' that result in irregular operation and short lifetime.

As noted above, to eliminate surface breakdowns along the spacers, the potential surface discharge path along the spacers should be several times longer than the path length of the volume discharge. In the design of FIG. 1B, these path lengths are equal. An improved design in this respect, but still lacking well-defined discharge regions, is shown in FIG. 1C. Planar electrodes 10" are separated by insulating, spacers 12" that have corrugated outer surfaces. The corrugations increase the lengths of the spark propagation paths along the outer surfaces of spacers 12", but in practice, in such a design, the threshold voltage for surface breakdown can not exceed the threshold voltage for volume breakdown. Therefore, even in the design of FIG. 1C, undesired surface discharges occur quite often.

Another disadvantage of the designs of FIGS. 1B and 1C is that it is impractical to produce spacers 12' for gaps of about 1 millimeter or less, or spacers 12" for gaps of a few millimeters or less, for three reasons. First, spacers 12' and 12" generally are made of ceramic materials, which are too fragile to withstand the mechanical shocks associated with repeated switch discharge. Second, the corrugations of spacers 12" are less effective in preventing a surface breakdown on such a small scale. Third, small insulators are more sensitive than large insulators to local imperfections such as impurities in the ceramic.

FIG. 2 is a partial perspective view of a simple multistage spark gap switch of the present invention. In FIG. 2 are shown three planar electrodes 20*a*, 20*b* and 20*c*, representative of a stack of parallel planar electrodes 20. Each electrode 20 has a discharge portion 24 and a support portion 26. Discharge portions 24 are positioned opposite each other to define discharge gaps 28 therebetween. Spacers 22, of which only one is shown in FIG. 2, are placed between support portions 26, as in the prior art multistage spark gap switches, to separate electrodes 20. Support portions 26 also serve to conduct heat away from discharge portions 24. Unlike the prior art multistage spark gap switch, support portions 26 are staggered so that spacers 22 separate non-adjacent electrodes 20. So, for example, in FIG. 2, support portion 26*b* is staggered with respect to support portions 26*a* and 26*c*. As a result, the length of the multistage spark gap switch of FIG. 2 is determined only by the thickness of electrodes 20 and the width of discharge gaps 28.

A. Anvari and O. Steinvall, in "Study of a 40 kV multistage spark gap operated in air at atmospheric pressure", *Journal of Physics E*, vol. 6 (1973) pp. 1113–1115, presented a multistage spark gap with planar, disc-shaped electrodes separated by annular separators. Their design resembles the design of FIG. 1B. However, to confine the discharge portions of the electrodes to the vicinity of the electrode centers, and in particular to avoid spark propagation along the sides of the spacers, the electrodes were provided with small central holes, and a trigatron arrangement was used to trigger the switch. The electrodes were spaced 4 mm apart. This design is unsuitable for electrodes spaced about one millimeter or less apart because the separators would be too fragile to withstand the shocks associated with repeated discharge. Another disadvantage of this design is its lack of a proper self-closing capability, due to the equal lengths of the potential surface and volume discharge paths, which result in frequent surface discharges along the surfaces of the separators.

In a multistage spark gap switch the present invention, planar electrodes 20 have relatively large, well-defined discharge portions 24 and are spaced relatively close to each other, as compared to prior art multistage spark gap switches. This gives the multistage spark gap switch of the present invention more compactness, a longer lifetime and better reproducibility than the prior art multistage spark gap switches, as well as self-closing capability.

The embodiment of FIG. 2 is not a preferred embodiment of the present invention. It is presented herein only to illustrate the principle of the present invention. Preferred embodiments of the present invention are presented below.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a multistage spark gap switch that is more compact than those known heretofore.

The principles and operation of a multistage spark gap switch according to the present invention may be better understood with reference to the drawings and the accompanying description.

Figure 3A:
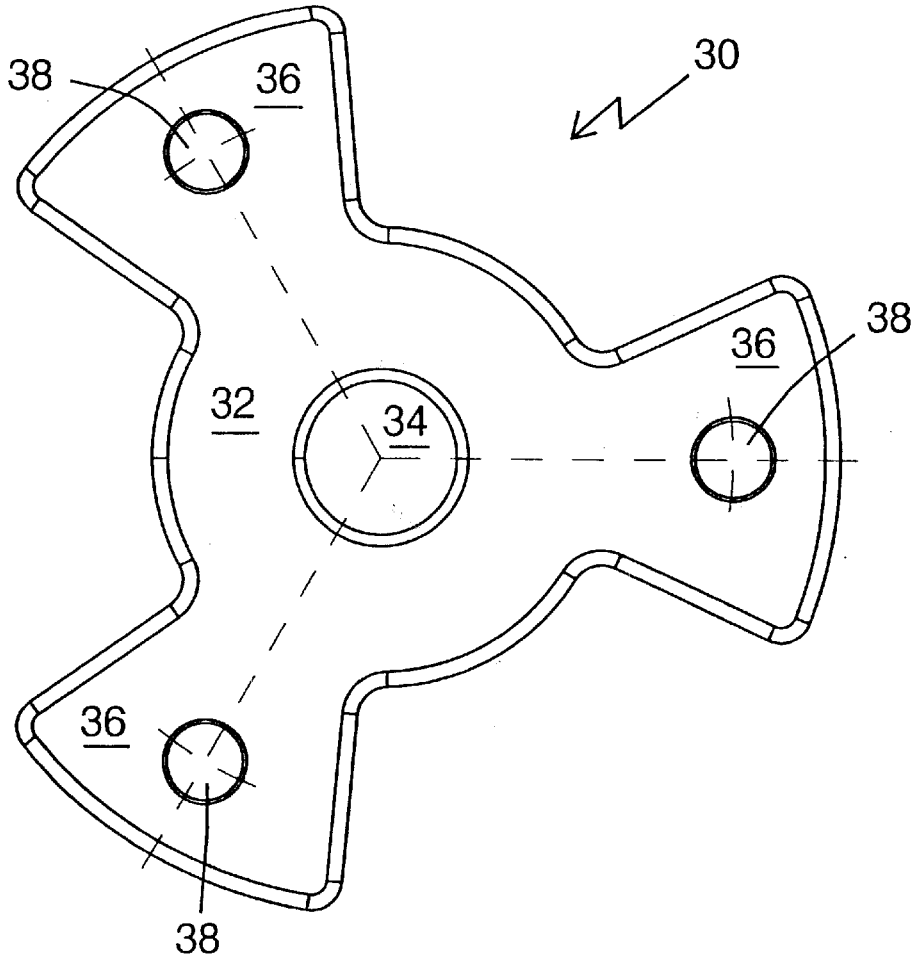
FIG. 3 shows a preferred embodiment of a planar electrode.
Figure 3B:
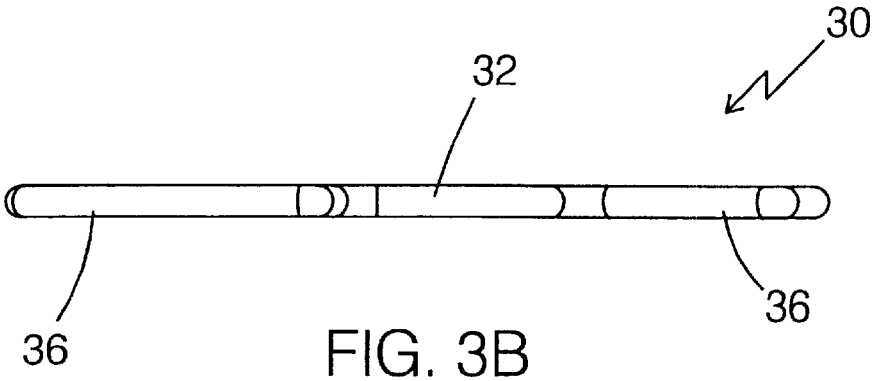

Referring now to the drawings, FIGS. 3A (top view) and 3B (side view) show a preferred planar electrode 30 of the present invention. Electrode 30 includes a central discharge portion 32 from which project three lobes 36 that constitute the support portion of electrode 30. Discharge portion 32 is annular and has a central hole 34. Each lobe 36 includes a hole 38 that accommodates a spacer.

Figure 4A:
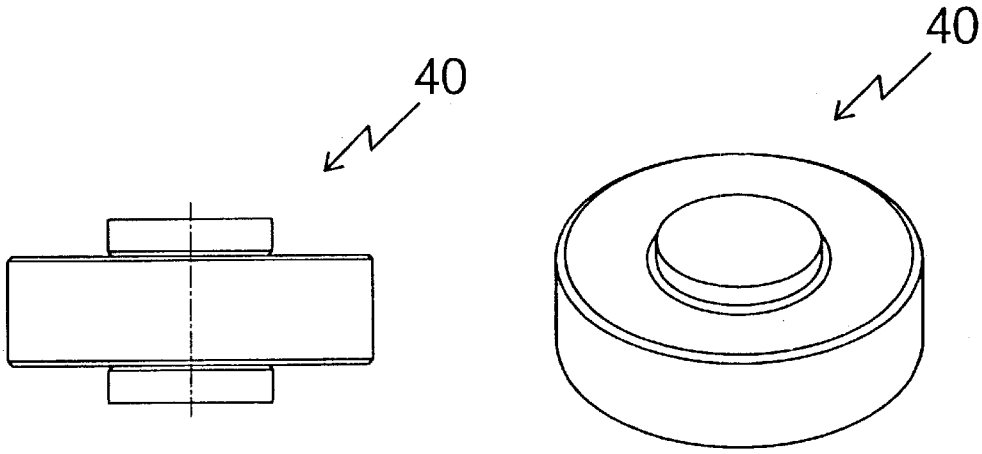
FIGS. 4A and 4B show two designs for spacers.
Figure 4B:
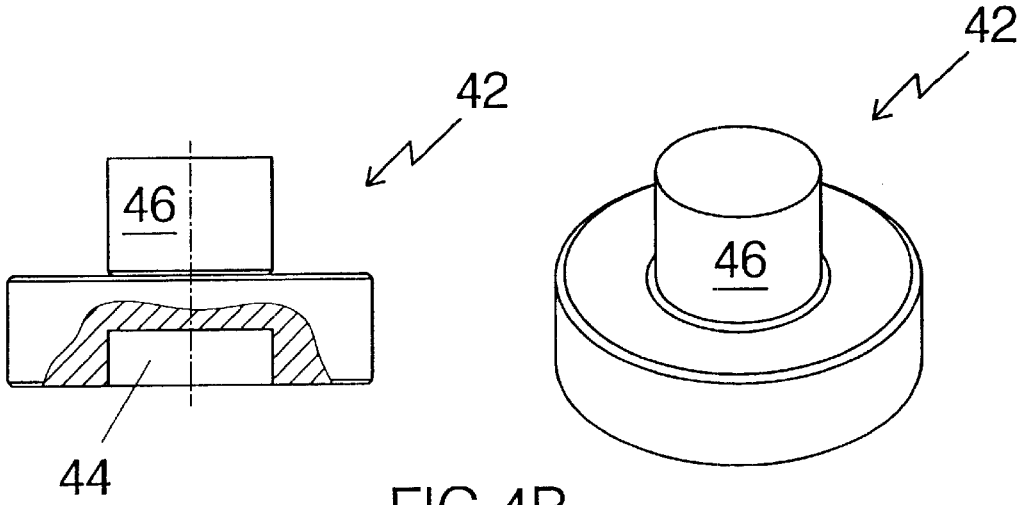
Figure 5A:
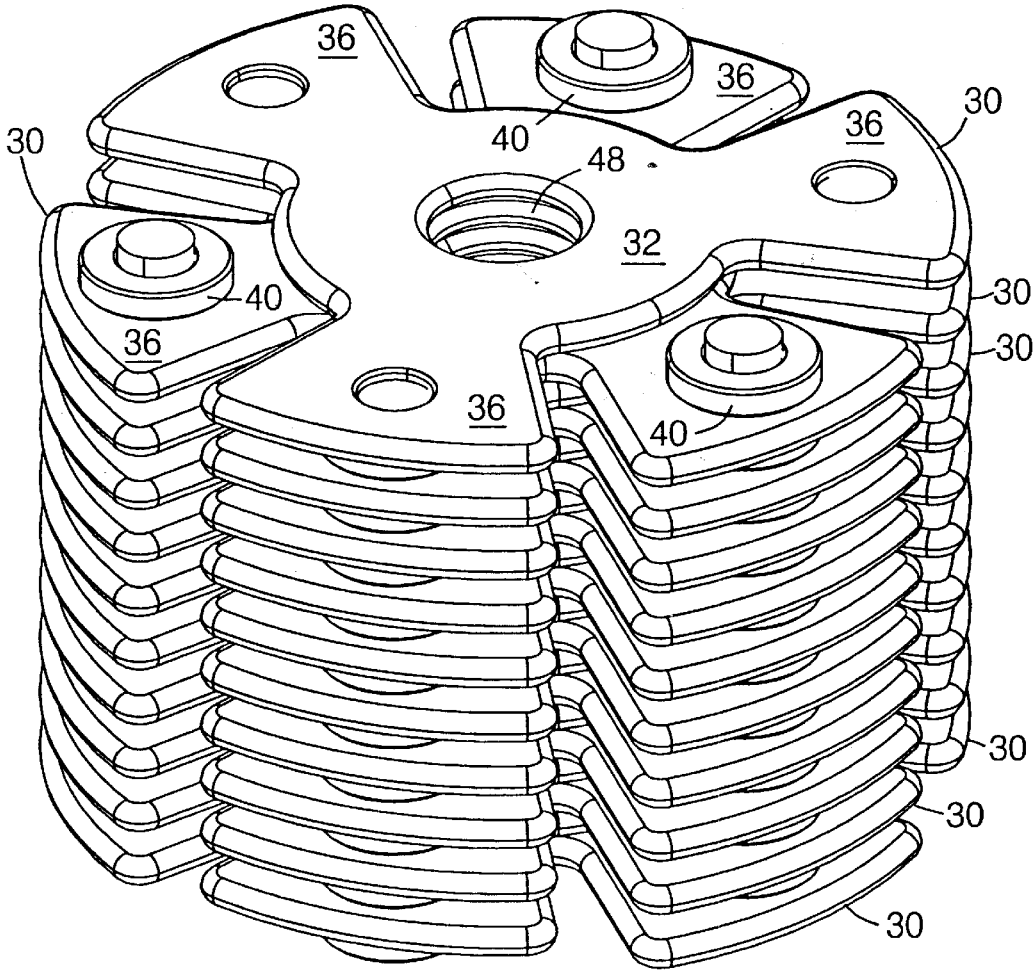
FIG. 5A is a perspective view of a stack of the electrodes of FIG. 3, in two interleaved substacks, separated by the spacers of FIG. 4A.

FIGS. 4A and 4B show two designs 40 and 42 for spacers. Spacer 42 is drawn partly in section to show socket 44 that accommodates tip 46 of a preceding spacer 42. FIG. 5A shows an assembled stack of 20 parallel electrodes 30, separated by spacers 40. Note that lobes 36 of successive electrodes 30 are staggered, so that there are two interleaved substacks of 10 electrodes 30 each, with electrodes 30 of each substack separated by spacers 40. Holes 34 define a channel 48 for axial fluid flow. Channel 48 also enhances the coupling between discharge gaps by optical mechanisms, mainly UV photons.

Preferably, electrodes 30 are made of aluminum and spacers 40 or 42 are made of alumina. Aluminum has a relatively low sputtering coefficient, which prolongs the lifetime of electrodes 30, and a relatively high heat conductivity, which shortens recovery time and also prolongs the lifetime of electrodes 30. If the insulating medium is air, the main sputtering product is alumina, the same material as spacers 40 or 42. Other electrode materials, such as brass, tend to produce a conductive coating on spacers 40 or 42.

Figure 5B:
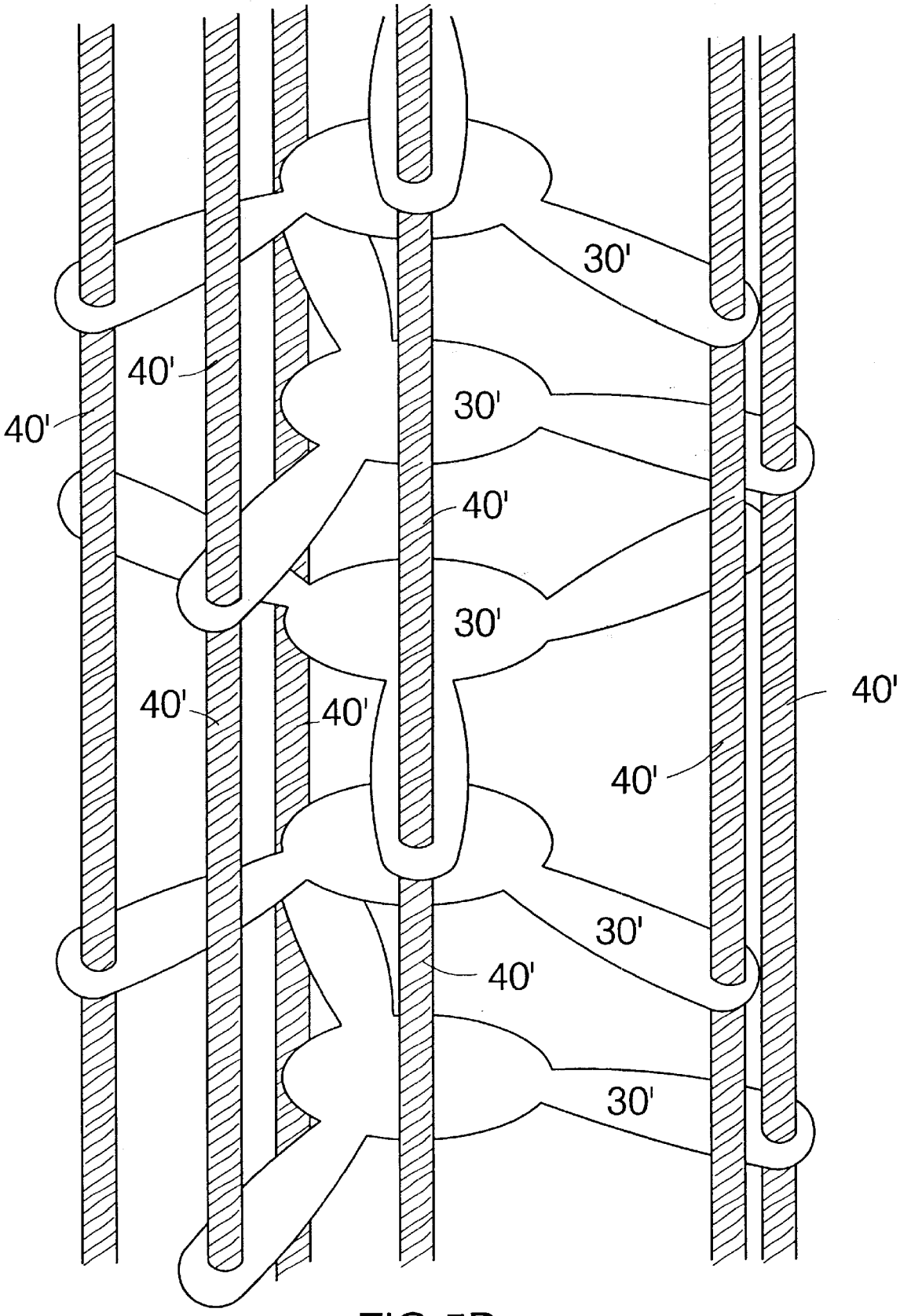
FIG. 5B is a schematic perspective illustration of a stack of the electrodes of FIG. 3 in three interleaved substacks.

In general, an electrode stack of the present invention includes N independent interleaved substacks, staggered with respect to each other. The electrodes of any particular substack are N discharge gaps apart. FIG. 5A illustrates the usually preferred case of N=2. N>2, with the concomitant longer spacers 40 or 42, and longer and narrower lobes 36, is useful if electrodes 30 are particularly thin or if the gaps between electrodes 30 are large. FIG. 5B illustrates the case of N=3, with three interleaved substacks of electrodes 30', each substack with its own set of spacers 40'.

Let g represent the axial gap width between two electrodes and let d represent the thickness of an electrode. As a rule, the axial length S=N(g+d)−d of the portion of spacers 40 or 42 that separates two electrodes 30 of a particular substack should be at least 3 times the corresponding cumulative axial gap width G=Ng. For example, if electrodes 30 are 2 mm thick and the gaps between electrodes 30 are 0.5 mm wide, then with N=2 (cumulative gap width of 1 mm), the spacers are 3 mm long, and with N=3 (cumulative gap width of 1.5 mm), the spacers are 5.5 mm long, so either N=2 or N=3 is a satisfactory design. If electrodes 30 are 3 mm thick and the gaps between electrodes 30 are 1 mm wide, then N=3 (cumulative gap width of 3 mm) gives a spacer length of 9 mm, which is satisfactory, but N=2 (cumulative gap width of 2 mm) gives a spacer length of 5 mm, which is unsatisfactory.

The rule of thumb S≧3G gives the following relationship for the ratio R between electrode thickness d and gap width g:

$$R \geqq 2N/(N-1)$$

Figure 1A:
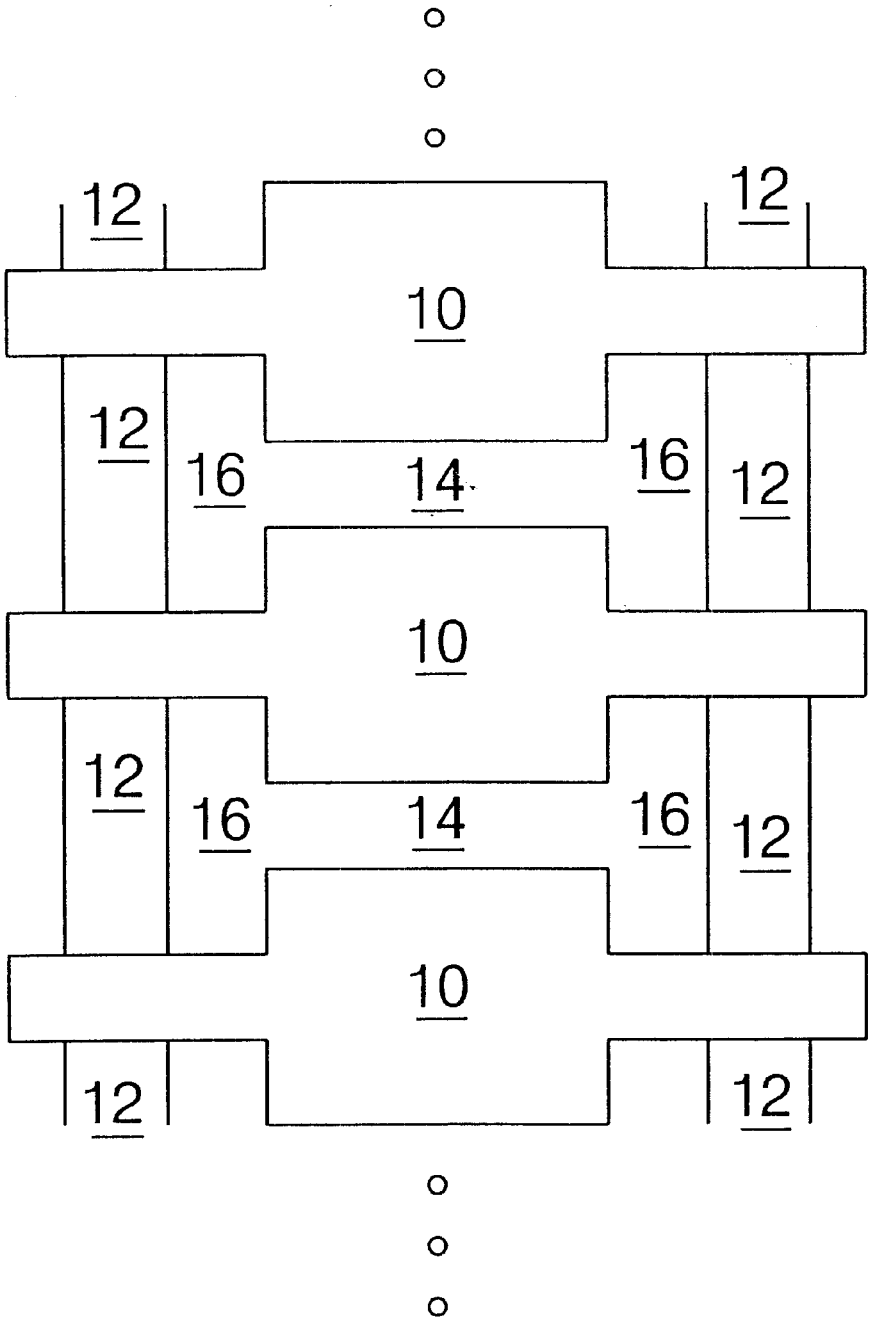
FIG.1A (PRIOR ART)
FIGS. 1A, 1B and 1C are schematic depictions of prior art multistage spark gap switches.
Figure 1B:
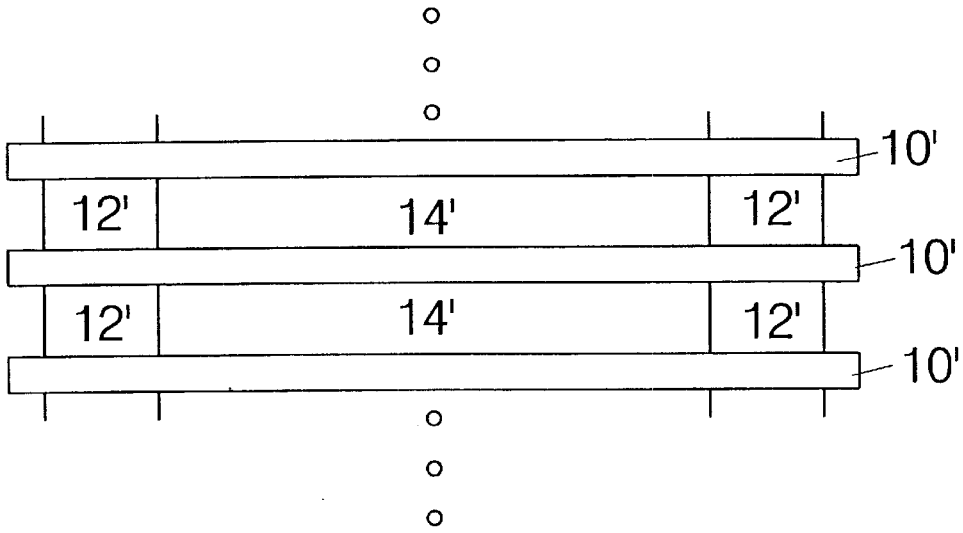
FIG.1B (PRIOR ART)
Figure 1C:
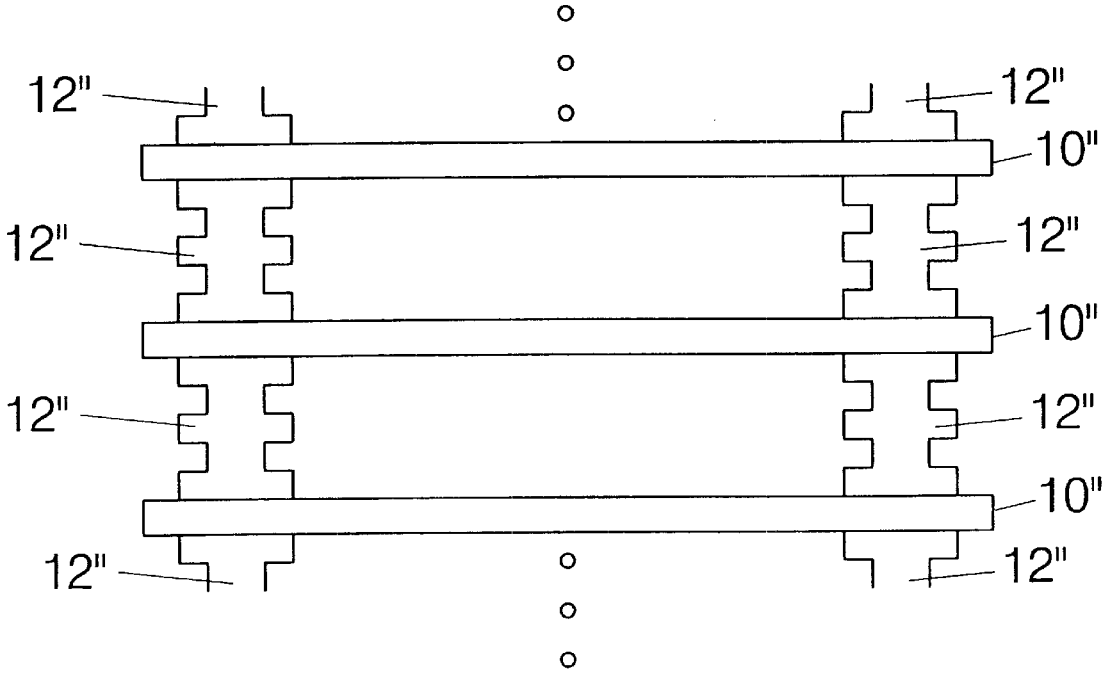
FIG.1C (PRIOR ART)
Figure 2:
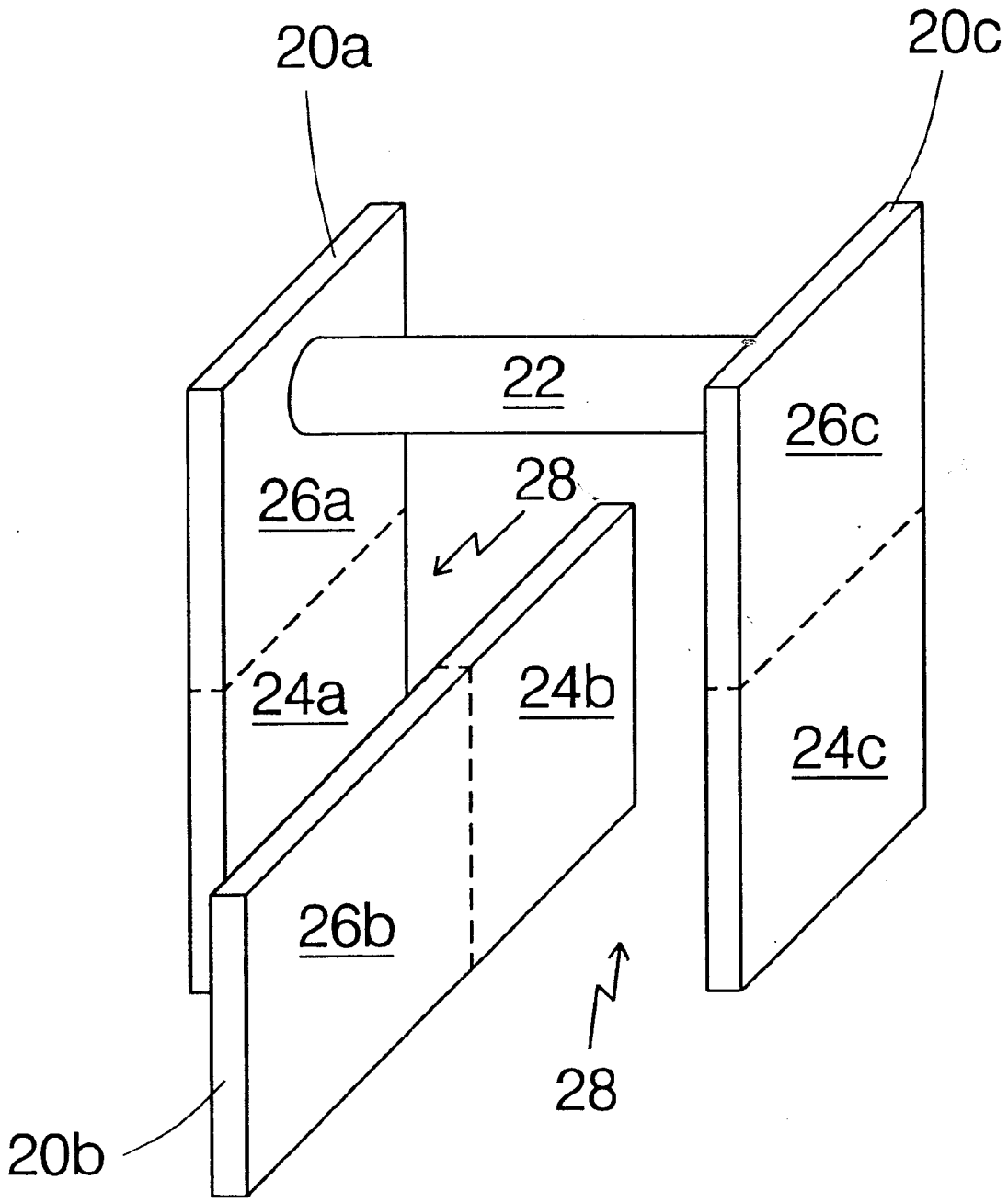
FIG. 2 is a partial perspective view of a simple embodiment of the present invention.

So N=2 requires R≧4, N=3 requires R≧3, and as N grows large, the minimum value of R approaches 2. Using corrugated spacers, as in the prior art design of FIG. 1C, the rule of thumb can be relaxed, and electrodes 30 can be made thinner for a given gap width g, producing an even more compact switch.

The complete multistage spark gap switch of the present invention includes appropriate packaging for the stack of electrodes. Separate components of packaging for the electrode stack of FIG. 5A are shown in FIGS. 6, 7 and 8.

Figure 6A:
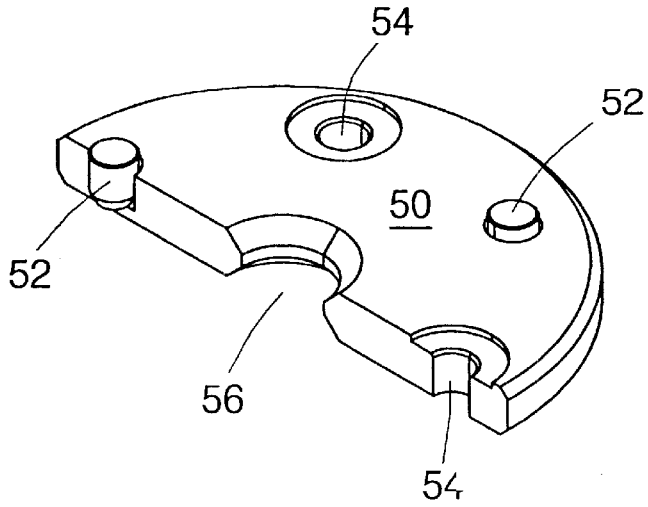
FIG. 6 shows an end cap.
Figure 6B:
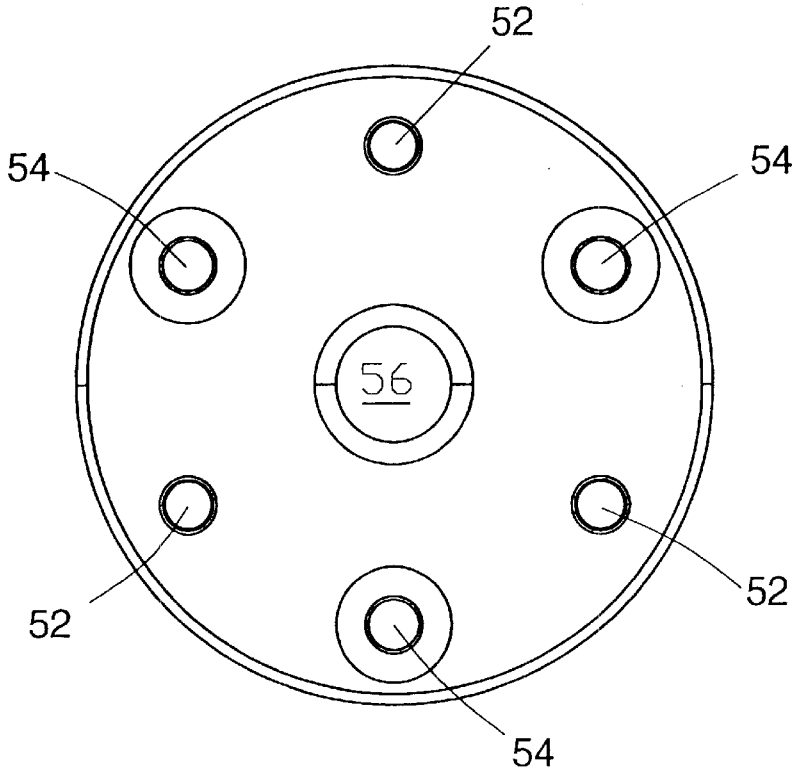

FIGS. 6A (perspective axial section) and 6B (top view) show an end cap 50, two of which are mounted on the outermost electrodes 30 of the electrode stack of FIG. 5A. End cap 50 includes three pins 52 that fit into holes 38 of the adjacent outermost electrode 30 and three sockets 54 that accommodate the outermost spacers 40. End cap 50 also includes a central hole 56 that helps to define channel 48.

Figure 7A:
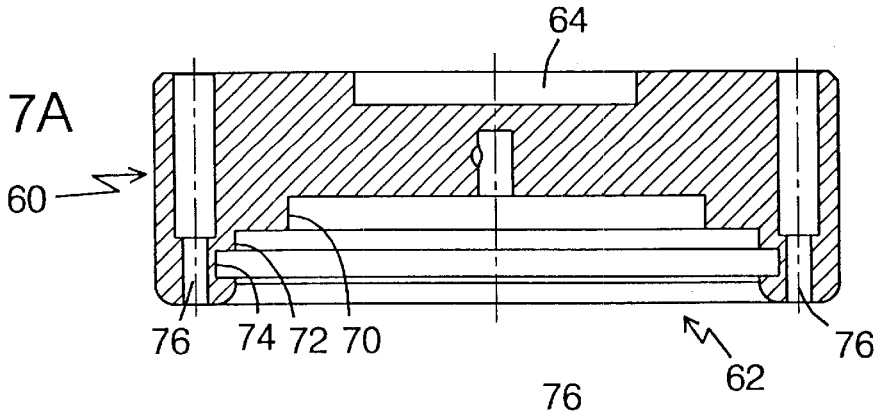
FIG. 7 shows an end flange.
Figure 7B:
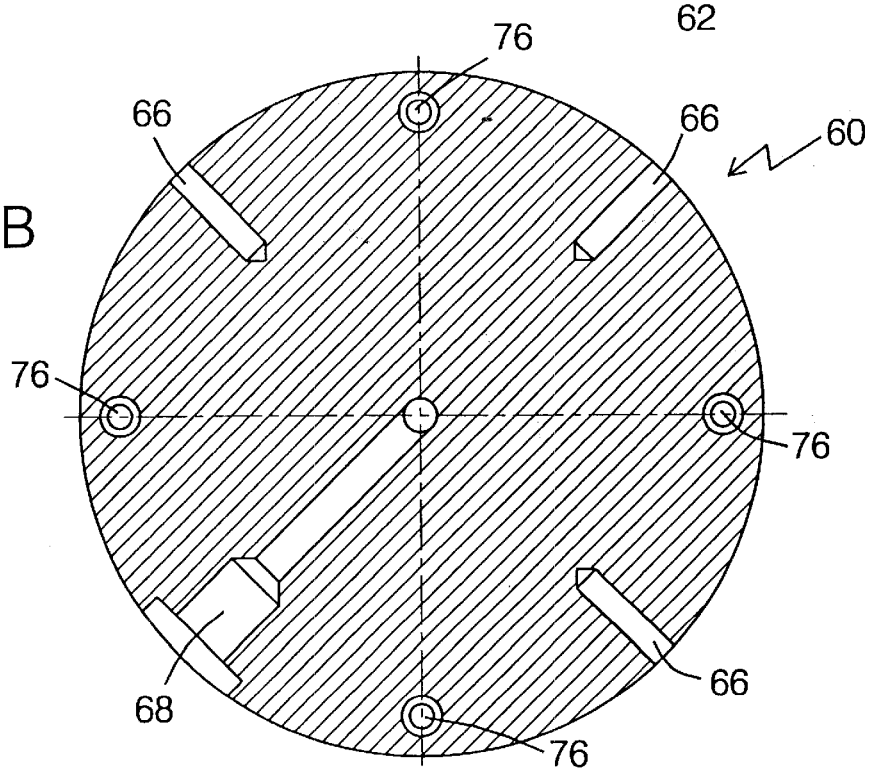
Figure 7C:
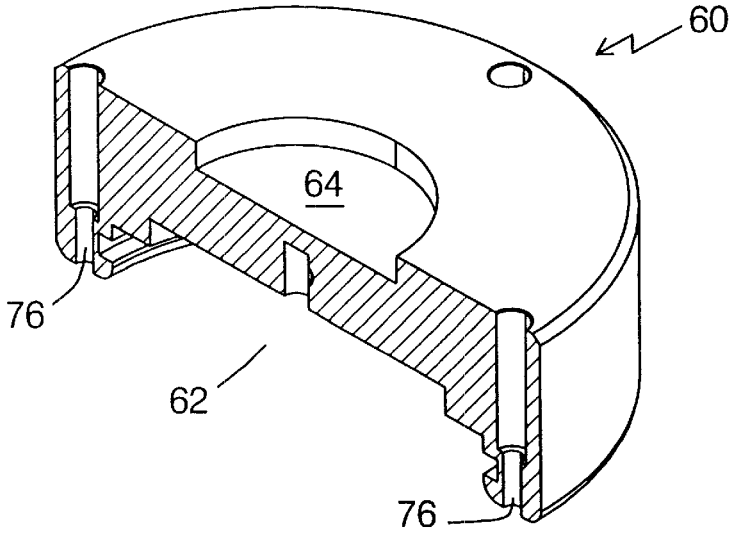
Figure 8A:
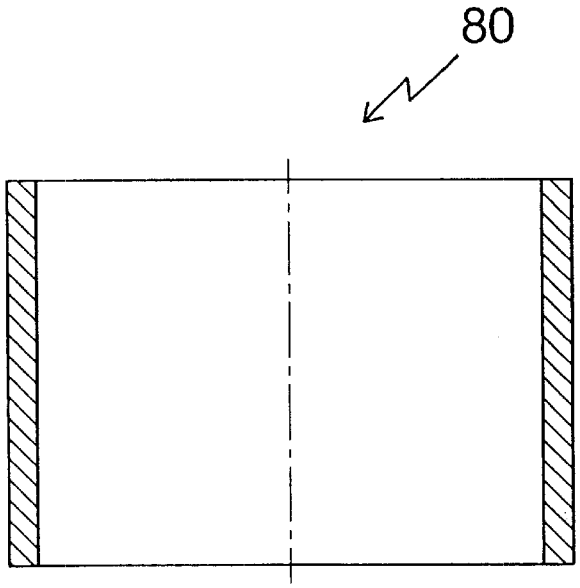
FIG. 8 shows a ceramic sleeve.
Figure 8B:
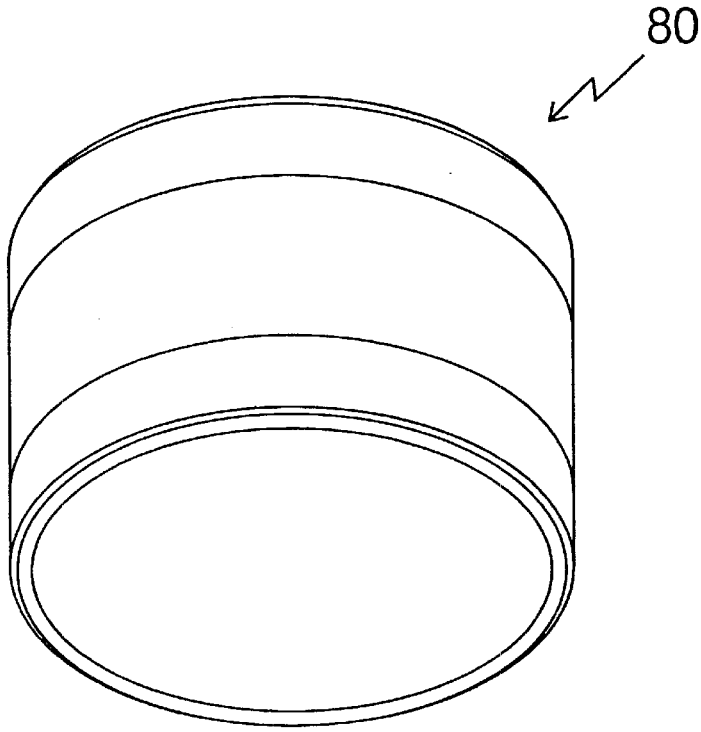

FIGS. 7A (axial section), 7B (transverse section) and 7C (perspective axial section) show an end flange 60. The electrode stack of FIG. 5A is mounted between two such end flanges 60, with the outermost electrodes 30 pressed against end caps 50 and against end flanges 60 to form an ohmic contact. A stepped center depression 62 in one face of end flange 60 accommodates end cap 50 in step 70. Mounting socket 64 in the other face of end flange 70 is used for mounting the multistage spark gap switch. Sockets 66 are provided for the necessary HV connections. Channel 68 is an interface for the insulating fluid: in one end flange 60, channel 68 is a fluid inlet; in the other end flange 60, channel 68 is a fluid outlet. The multistage spark gap switch is sealed using a cylindrical ceramic sleeve 80, shown in axial section in FIG. 8A and in perspective in FIG. 8B, and two o-rings (not shown). Step 74 of center depression 62 accommodates one o-ring. The electrode stack is positioned inside sleeve 80 and the two end flanges 60 are pressed onto the two ends of sleeve 80, so that the two ends of sleeve 80 are accommodated in step 72 of center depression 62 and the o-rings form a seal against sleeve 80. Holes 76 admit insulating rods (not shown) whose ends are threaded to receive nuts (also not shown); these rods and nuts hold the assembled multistage spark gap switch together.

In a variant on the design illustrated in FIGS. 3–8, electrodes 30 lack central holes 34 and end caps 50 lack central holes 56. The insulating fluid flows through this variant around the peripheries of electrodes 30.

Two different variants of this multistage spark gap switch correspond to three different trigger schemes, illustrated in FIG. 9. The principle of all three schemes is to induce a voltage breakdown by momentarily raising the voltage in the discharge gaps above the self-breakdown voltage. In FIG. 9, the multistage spark gap switches are represented schematically by stacks of electrodes 30 defining channel 48 and flanked by end flanges 60. Also shown schematically in FIG. 9 are sources 84 and sinks 86 of insulating fluid.

Figure 9A:
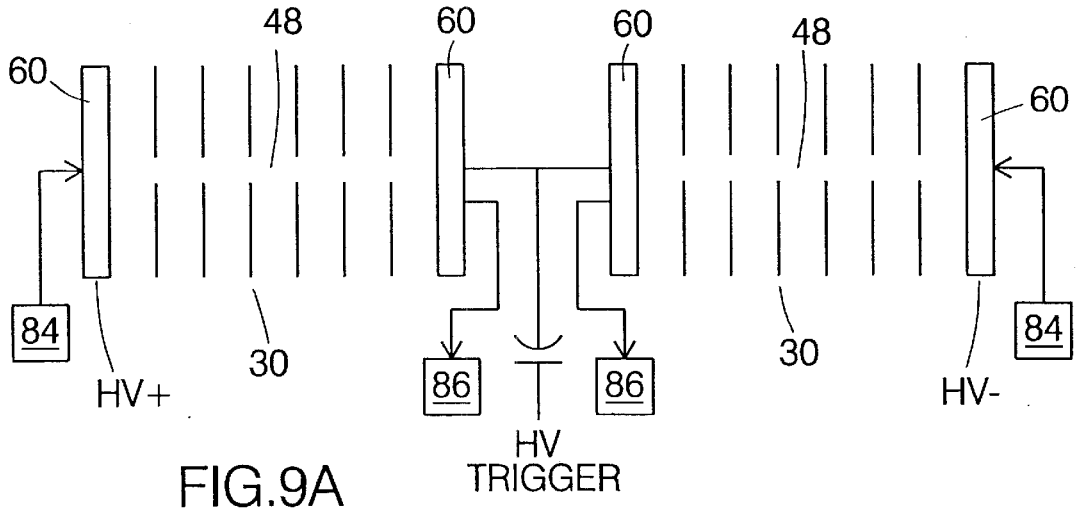
FIG. 9 illustrates three different trigger schemes.

In the first trigger scheme, illustrated in FIG. 9A, two multistage spark gap switches are connected back to back, and the HV trigger pulse is introduced to the two center end flanges 60. The trigger generator is capacitively isolated from the spark gap switches.

Figure 9B:
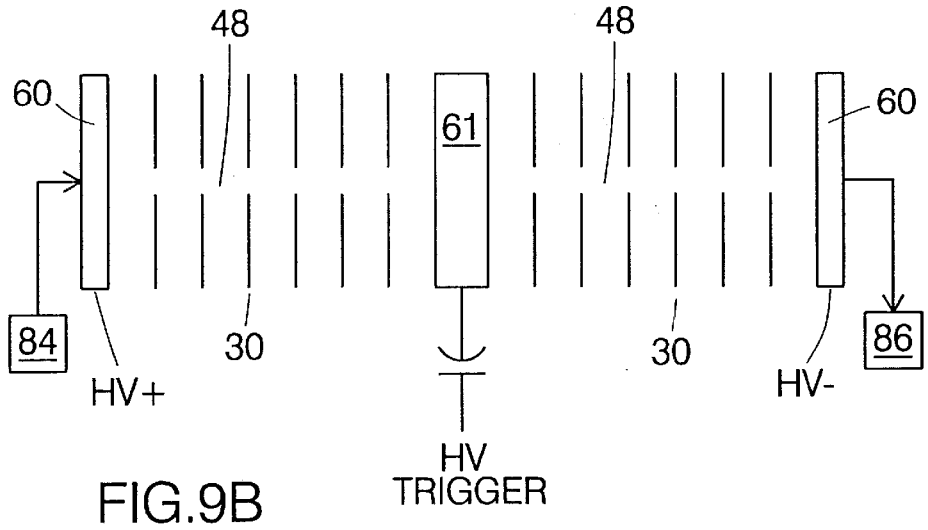

In the second trigger scheme, illustrated in FIG. 9B, the two center end flanges 60 are combined to form a single center flange 61. This scheme uses a direct ohmic contact to the center electrodes 30. Center flange 61 has sockets analogous to sockets 66 and two center depressions analogous to center depression 62. Instead of a channel 68, center flange 61 has a central circular hole (not shown) that helps to define fluid channel 48. The mechanical advantage of this variant over a simple multistage switch with the same total number of stages is that in this variant, cumulative departures from design criteria such as strict parallelism of electrodes 30 and uniform interelectrode gap widths are accumulated over only half as many stages.

Figure 9C:
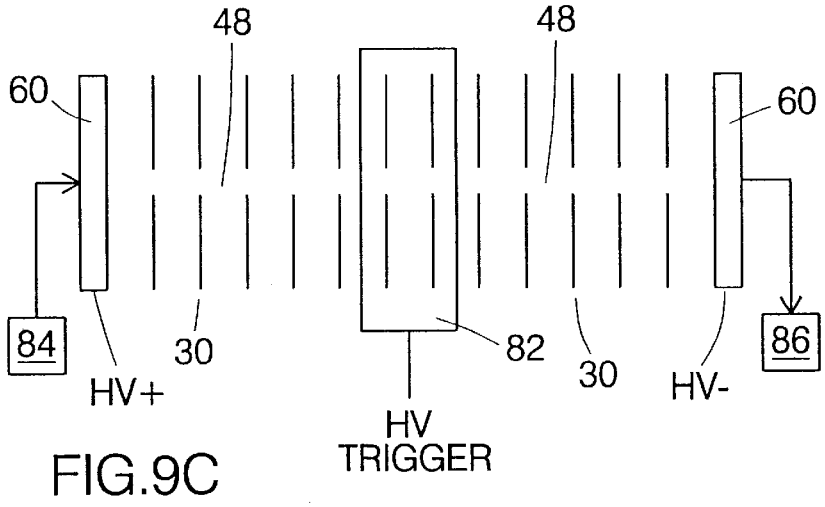

The third trigger scheme, illustrated in FIG. 9C, uses a capacitive trigger. A circumferential conductor, such as a conducting ribbon 82, encircles ceramic sleeve 80 at the middle of the stack. The trigger pulse is introduced to ribbon 82 and the pulse voltage is capacitively divided between the ribbon-stack capacitance (high) and the half-stack capacitance (low). Thus, the trigger voltage is transferred to the middle region of the electrode stack, and the process proceeds as in the second trigger scheme. The electrical advantage of the third scheme is its inherent capacitive isolation of the trigger generator and its consequent low trigger current/energy consumption.

As noted above, one of the advantages of multistage spark gap switches generally is that they can be operated at atmospheric pressure. This is true, of course, for the switch of the present invention. Nevertheless, using air as the insulating medium, it has been found advantageous to operate the switch of the present invention at pressures from 0 to 12 psi above atmospheric, with the preferred range being from 3 to 5 psi above atmospheric pressure. Because the breakdown voltage increases monotonically with the pressure of the gaseous insulating medium, using pressures several psi above atmospheric increases the dynamic range of the switch.

Substituting inert gases such as nitrogen or noble gases such as helium or xenon, or mixtures thereof, for air as the insulating medium has the advantage of increasing switch lifetime.

Preferred structural and operational parameters for an N=2 multistage spark gap switch of the present invention are as follows:

gap g=0.5 mm insulating medium: air at between 3 psi and 5 psi above atmospheric pressure voltage drop per gap: between 1 kV and 2 kV current: hundreds of amperes to several kiloamperes The total holdoff voltage is the product of the voltage drop per gap and the number of gaps. In a typical 39-stage switch of the present invention, this holdoff voltage is about 40 kV.

while the invention has been described with respect to a limited number of embodiments, it will be appreciated that many variations, modifications and other applications of the invention may be made.

What is claimed is:

1. A spark (gap switch, comprising:

(a) a first substantially planar electrode including a discharge portion and a support portion; and (b) a second substantially planar electrode parallel to and spaced apart from said first electrode and including a discharge portion and a support portion, said discharge portions being, mutually opposite, and said support portions being mutually staggered; and (c) a third substantially planar electrode parallel to said second electrode and including a discharge portion and a support portion, said second electrode being between said first electrode and said third electrode and spaced apart from said first electrode and said third electrode, said discharge portions of said second and third electrodes being mutually opposite, said support portions of said second and third electrodes being mutually staggered.

2. The spark gap switch of claim 1, wherein said discharge portions are spaced apart by at most about one millimeter.

3. The spark gap switch of claim 1, further comprising:

(d) at least one fourth substantially planar electrode parallel to said third electrode, each of said at least one fourth electrode including a discharge portion and a support portion, all of said at least one fourth electrode being between said second electrode and said third electrode and spaced apart from each other and from said second and third electrodes, said discharge portions of adjacent said at least one fourth electrode being mutually opposite, said discharge portion of said fourth electrode that is adjacent said second electrode being opposite said discharge portion of said second electrode, said discharge portion of said fourth electrode that is adjacent said third electrode being opposite said discharge portion of said third electrode, all of said support portions of said at least one fourth electrode being mutually staggered and being staggered relative to said support portions of said second and third electrodes.

4. The spark gap switch of claim 1, further comprising:

(d) a fourth substantially planar electrode parallel to said third electrode and including a discharge portion and a support portion, said third electrode being between said second electrode and said fourth electrode and spaced apart from said second electrode and said fourth electrode, said discharge portions of said third and fourth electrodes being mutually opposite, said support portions of said third and fourth electrodes being mutually staggered.

5. The spark gap switch of claim 1, further comprising:

(d) at least one insulating spacer between and in contact with said support portions of said first and third electrodes.

6. The spark gap switch of claim 1, wherein said support portion of said first electrode includes a plurality of lobes extending outward from said discharge portion of said first electrode.

7. The spark gap switch of claim 1, wherein said discharge portions are annular, said annuli defining a fluid flow channel.

8. The spark gap switch of claim 7, further comprising:

(c) a mechanism for causing a fluid to flow through said fluid flow channel.

9. The spark gap switch of claim 8, wherein said fluid is air.

10. The spark gap switch of claim 9, wherein said air is substantially at atmospheric pressure.

11. The spark gap switch of claim 9, wherein said air is at a pressure of up to about 12 psi above atmospheric pressure.

12. The spark gap switch of claim 11, wherein said air is at a pressure between about 3 psi above atmospheric pressure and about 5 psi above atmospheric pressure.

13. The spark gap switch of claim 8, wherein said fluid includes a gas selected from the group consisting of nitrogen and noble gases.

14. A spark gap switch comprising:

(a) a first stack of at least two substantially planar, mutually parallel electrodes, each of said electrodes including:

(i) a discharge portion, and (ii) a support portion, said discharge portions of adjacent said electrodes being spaced apart and mutually opposite, said support portions of adjacent said electrodes being mutually staggered, said discharge portions being annular, said annuli defining a fluid flow channel; and (b) a mechanism for causing a fluid to flow through said fluid flow channel.

15. The spark gap switch of claim 14, further comprising:

(b) a trigger mechanism, for applying a high voltage pulse to an outer electrode of said first stack.

16. The spark gap switch of claim 15, wherein said trigger mechanism is capacitively isolated from said outer electrode.

17. The spark gap switch of claim 15, further comprising:

(c) a second stack of at least two substantially planar, mutually parallel electrodes, each of said electrodes of said second stack including:

(i) a discharge portion, and (ii) a support portion;

said discharge portions of adjacent said electrodes of said second stack being spaced apart and mutually opposite, said support portions of adjacent said electrodes of said second stack being mutually staggered, said trigger mechanism being configured to apply said high voltage pulse simultaneously to said outer electrode of said first stack and to an outer electrode of said second stack.

18. The spark gap switch of claim 14, further comprising:

(b) a trigger mechanism for capacitively applying a high voltage pulse to said first stack of electrodes.

19. The spark gap switch of claim 18, wherein said trigger mechanism includes a circumferential conductor encircling and spaced apart from said first stack.

20. The spark gap switch of claim 14, wherein said fluid is air.

21. The spark gap switch of claim 20, wherein said air is substantially at atmospheric pressure.

22. The spark gap switch of claim 20, wherein said air is at a pressure of up to about 12 psi above atmospheric pressure.

23. The spark gap switch of claim 22, wherein said air is at a pressure between about 3 psi above atmospheric pressure and about 5 psi above atmospheric pressure.

24. The spark gap switch of claim 14, wherein said fluid includes a gas selected from the group consisting of nitrogen and noble gases.

25. A spark gap switch comprising:

(a) a first stack of at least two substantially planar, mutually parallel electrodes, each of said electrodes including a discharge portion, said discharge portions of adjacent said electrodes being mutually opposite and spaced apart by at most about one millimeter, said discharge portions being annular, said annuli defining a fluid flow channel and (b) a mechanism for causing a fluid to flow through said fluid flow channel.

26. The spark gap switch of claim 25, further comprising:

(b) at least one insulating spacer, having a smooth outer surface, for maintaining said electrodes in said spaced apart relationship.

27. The spark gap switch of claim 25, further comprising:

(b) a trigger mechanism, for applying a high voltage pulse to an outer electrode of said first stack.

28. The spark gap switch of claim 27 wherein said trigger mechanism is capacitively isolated from said outer electrode.

29. The spark gap switch of claim 27, further comprising:

(c) a second stack of at least two substantially planar, mutually parallel electrodes, each of said electrodes of said second stack including a discharge portion, said discharge portions of adjacent said electrodes of said second stack being mutually opposite and spaced apart by at most about one millimeter, said trigger mechanism being configured to apply said high voltage pulse simultaneously to said outer electrode of said first stack and to an outer electrode of said second stack.

30. The spark gap switch of claim 25, further comprising:

(b) a trigger mechanism for capacitively applying a high voltage pulse to said first stack of electrodes.

31. The spark gap switch of claim 30, wherein said trigger mechanism includes a circumferential conductor encircling and spaced apart from said first stack.

32. The spark gap switch of claim 25, wherein said fluid is air.

33. The spark gap switch of claim 32, wherein said air is substantially at atmospheric pressure.

34. The spark gap switch of claim 32, wherein said air is at a pressure of up to about 12 psi above atmospheric pressure.

35. The spark gap switch of claim 34, wherein said air is at a pressure between about 3 psi above atmospheric pressure and about 5 psi above atmospheric pressure.

36. The spark gap switch of claim 25, wherein said fluid includes a gas selected from the group consisting of nitrogen and noble gases.

37. A spark gap switch, comprising:

(a) a first substantially planar electrode including a discharge portion and a support portion, said support portion including a plurality of lobes extending outward from said discharge portion; and (b) a second substantially planar electrode parallel to and spaced apart from said first electrode and including a discharge portion and a support portion, said discharge portions being mutually opposite, and said support portions being mutually staggered.

38. A spark gap switch, comprising:

(a) a first substantially planar electrode including a discharge portion and a support portion; and (b) a second substantially planar electrode parallel to and spaced apart from said first electrode and including a discharge portion and a support portion, said discharge portions being mutually opposite, said discharge portions being annular, said annuli defining a fluid flow channel, and said support portions being mutually staggered.

39. A spark gap switch comprising:

(a) a first stack of at least two substantially planar, mutually parallel electrodes, each of said electrodes including:

(i) a discharge portion, and (ii) a support portion, said discharge portions of adjacent said electrodes being spaced apart and mutually opposite, said support portions of adjacent said electrodes being mutually staggered; and (b) a trigger mechanism, for capacitively applying a high voltage pulse to said first stack of electrodes, and including a circumferential conductor encircling and spaced apart from said first stack.

* * * * *